US006929198B2

(12) United States Patent
Dexter

(10) Patent No.: US 6,929,198 B2
(45) Date of Patent: Aug. 16, 2005

(54) PRESSURE WASHER ASSEMBLY

(75) Inventor: Shane Dexter, Humboldt, TN (US)

(73) Assignee: DeVilbiss Air Power Company, Jackson, TN (US)

( * ) Notice: Subject to any disclaimer, the term of this patent is extended or adjusted under 35 U.S.C. 154(b) by 40 days.

(21) Appl. No.: 10/626,844

(22) Filed: Jul. 23, 2003

(65) Prior Publication Data

US 2004/0140379 A1 Jul. 22, 2004

Related U.S. Application Data

(60) Provisional application No. 60/398,342, filed on Jul. 23, 2002.

(51) Int. Cl.[7] ..... B05B 3/18

(52) U.S. Cl. ..... 239/754; 239/280; 239/280.5; 239/281; 239/525; 239/530; 239/532; 239/722; 239/451; 239/587.1; 239/456; 239/460

(58) Field of Search ..... 239/754, 280, 239/280.5, 281, 525, 530, 532, 722, 451, 587.1, 456, 460

(56) References Cited

U.S. PATENT DOCUMENTS

| | | | | |
|---|---|---|---|---|
| 3,423,027 A | * | 1/1969 | Ginther et al. | 239/754 |
| 3,508,709 A | * | 4/1970 | Serbousek et al. | 239/754 |
| 4,892,251 A | * | 1/1990 | Bresnen | 239/150 |
| 6,247,658 B1 | * | 6/2001 | Bakas | 239/722 |

* cited by examiner

*Primary Examiner*—David A. Scherbel
*Assistant Examiner*—James S. Hogan
(74) *Attorney, Agent, or Firm*—Suiter West Swantz pc llo

(57) ABSTRACT

A surface cleaner for assemblies having a spray nozzle such as pressure washers, spray wands, spray lances, and the like. The surface cleaner includes a guide having wheels in line with the spray nozzle for substantially maintaining the distance from the spray nozzle to a surface through a variety of angles assumed by the spray wand or the like. In exemplary embodiments, the guide is capable of being moved up and down the spray lance or the like for control of the cleaning force, and a set of markings may be provided on the guide, the spray lance, or the like for indicating the appropriate distance for the spray nozzle from many different surfaces. Additionally, the guide allows for one handed operation of the spray wand assembly.

29 Claims, 5 Drawing Sheets

PRESSURE WASHER ASSEMBLY

CROSS-REFERENCE TO RELATED APPLICATIONS

The present application claims the benefit under 35 U.S.C. § 119(*e*) of U.S. Provisional Application Ser. No. 60/398,342, filed Jul. 23, 2002. Said U.S. Provisional Application Ser. No. 60/398,342 is herein incorporated by reference in its entirety.

FIELD OF THE INVENTION

The present invention generally relates to pressure washer assemblies, and more particularly to a pressure washer assembly with a surface cleaner including a guide, wherein the guide allows for one handed operation while substantially maintaining a distance from the spray nozzle to the surface.

BACKGROUND OF THE INVENTION

Assemblies having a spray nozzle such as pressure washers, spray wands, spray lances, and the like are used for delivering a pressurized fluid stream to many different surfaces. For example, a spray wand connected to a pressure washer assembly may be used for cleaning a deck, a driveway, a roof, siding on a house, and the like. The pressure washer assembly may be supplied with water from a standard type outlet such as a garden hose. After pressurizing the water, the pressure washer assembly supplies the pressurized water stream to a spray wand which expels the pressurized water stream from a spray nozzle, delivering the pressurized water stream to a surface such as a deck for cleaning. Typically, the spray wand may include a gun having a trigger for regulating the flow of the pressurized water stream.

The use of a pressure washer assembly for the safe, effective, and even cleaning of different surfaces may require that the spray nozzle be held at varying distances from the different surfaces being cleaned. For example, during the course of a typical workday, a user may use a pressure washer assembly to clean stone, concrete, brick, and wood. While the spray nozzle of the pressure washer assembly may be held much closer to the stone, concrete, and brick, when cleaning the wood surface, the spray nozzle must be held farther away. If a proper distance from the wood is not maintained, the surface of the wood may splinter, damaging the wood and causing it to lose finish. Also, if a relatively constant distance is not maintained throughout the course of cleaning a surface, an uneven surface clean may result. Achieving an even surface clean may become increasingly difficult over the course of a typical workday, as a user of a pressure washer assembly may experience fatigue from swinging a spray wand, spray lance, or the like back and forth while attempting to maintain a relatively constant distance from a surface being cleaned.

For instance, a user cleaning a wooden deck with a spray wand and a pressure washer assembly may typically swing the spray wand back and forth in an arc. At either side of the arc, the spray nozzle will be farther away from the wooden deck than at the center. The wood at the center of the arc, closest to the spray nozzle, may be damaged by the pressurized water stream, while the wood to either side of the arc may not be effectively cleaned, leaving a striped pattern visible on the surface of the deck. In addition, it may be impossible for a user of a spray wand to maintain a constant distance from a vertical surface when using a longer or extensible spray wand. In the case of cleaning wooden siding on a house, the tiring motion of holding the spray wand aloft while swinging it back and forth to clean the siding may prevent a user from keeping the spray nozzle at a safe and effective distance from the siding, damaging the wooden siding and leaving an uneven clean.

To address the problem of maintaining an even distance from a surface and lessening user fatigue, surface cleaners have been used for providing a more even finish and for maintaining a constant distance from the spray nozzle to the surface being cleaned. Typically these surface cleaners have included a spray wand fixed at some angle and connected to a skirt, having a rotating set of nozzles beneath the skirt and a set of wheels attached to the outside of the skirt. However, these surface cleaners do not allow for the convenient adjustment of the distance from a spray nozzle to the surface, and the wheels on the side of the skirt make the footprint of the surface cleaner large and unwieldy for cleaning corners or tight spaces. Additionally, the size and weight of such a surface cleaner, in combination with the fixed angle of the spray wand attached to it, do not allow it to be used for cleaning vertical surfaces.

SUMMARY OF THE INVENTION

Consequently, the present invention is directed to a surface cleaner for a pressure washer assembly. The surface cleaner includes a guide, which may be made of plastic or other lightweight material, making it useful for cleaning vertical surfaces. The guide includes wheels in line with the spray nozzle, giving the surface cleaner of the present invention a small footprint for cleaning corners and tight spaces and substantially maintaining the distance from the spray nozzle to the surface through a variety of angles assumed by the spray wand or the like. In exemplary embodiments of the present invention, the guide is capable of being moved up and down the spray lance or the like for control of the cleaning force, and a set of markings may be provided on the guide, the spray lance, or the like for indicating the appropriate distance for the spray nozzle from many different surfaces. Additionally, the guide allows for one handed operation of the spray wand assembly.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
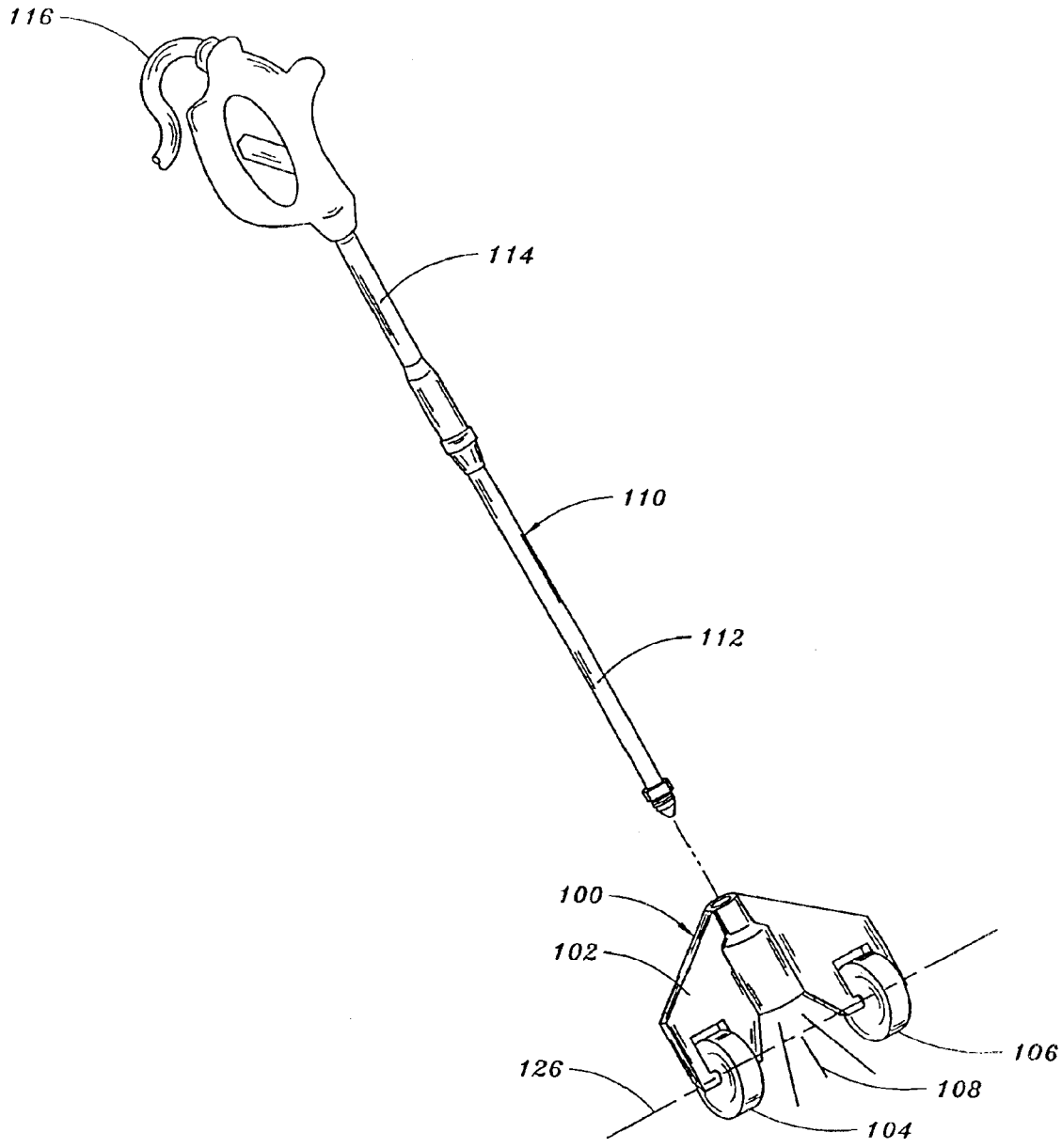
FIG. 1 is an exploded isometric view illustrating a surface cleaner assembly capable of being slidably connected to a spray wand for a pressure washer assembly in accordance with an exemplary embodiment of the present invention.

Reference will now be made in detail to the presently preferred embodiments of the invention, examples of which are illustrated in the accompanying drawings.

The use of a pressure washer assembly for cleaning a surface may offer several advantages. One such advantage offered by a pressure washer assembly is that the increased force of the pressurized water stream impacting the surface provides greater cleaning power. This may allow for the use of less water in cleaning the surface. Another advantage offered by a pressure washer assembly is that the force of the water impacting the surface may be controlled by adjusting the distance of the spray nozzle from the surface. The use of a rotary lance for expelling a rotating stream of pressurized fluid may agitate a surface, further increasing cleaning power. Additionally, many pressure washer assemblies have the ability to inject soaps, detergents, and the like into a pressurized water stream for added cleaning power.

One popular type of spray wand assembly includes two separate spray lances for controlling the pressure of water streams delivered to a surface and/or for adding soaps and detergents to one of the pressurized water streams. A side handle may be used to selectively supply water to one or both of the spray lances, reducing the pressure of the water streams when both spray lances are in use. Such a spray wand assembly may be used in combination with a soap or detergent injector at the pressure washer, providing a user with control of soap or detergent application. The pressure washer may inject soap or detergent into the pressurized fluid stream when the pressure is lowered by use of the side handle, while the high pressure mode may be used to rinse off the surface after the application of soap or detergent.

Other popular types of spray wand assemblies include spray wands and spray lances capable of being extended to different lengths for cleaning vertical surfaces from ground level. For example, a spray wand may include a spray lance capable of being separated into several pieces, both for adjusting the height of the spray wand and for easy storage and transportation. Another type of spray wand may include a spray lance having several pieces capable of sliding relative to one another, for providing an extensible spray wand for cleaning vertical surfaces.

Referring generally to FIGS. 1 through 6, a surface cleaner in accordance with exemplary embodiments of the present invention is described. The surface cleaner includes a guide that allows a user of the surface cleaner to deliver a pressurized fluid stream such as from a pressure washer, a spray wand, a spray lance, and the like through a spray nozzle coupled with the guide to a surface such as a deck, a driveway, a roof, siding on a house, and the like, while substantially maintaining a distance from the spray nozzle to the surface (hereinafter referred to as the impingement distance). In exemplary embodiments of the present invention, the spray nozzle is adjustably coupled with the guide for allowing a user of the surface cleaner to vary the impingement distance. Further, the surface cleaner may be made to fit a variety of pressure washer assembly configurations, including rotary lances, spray wands including two separate lances, spray wands including spray lances having separable or extensible components, and the like.

Figure 2:
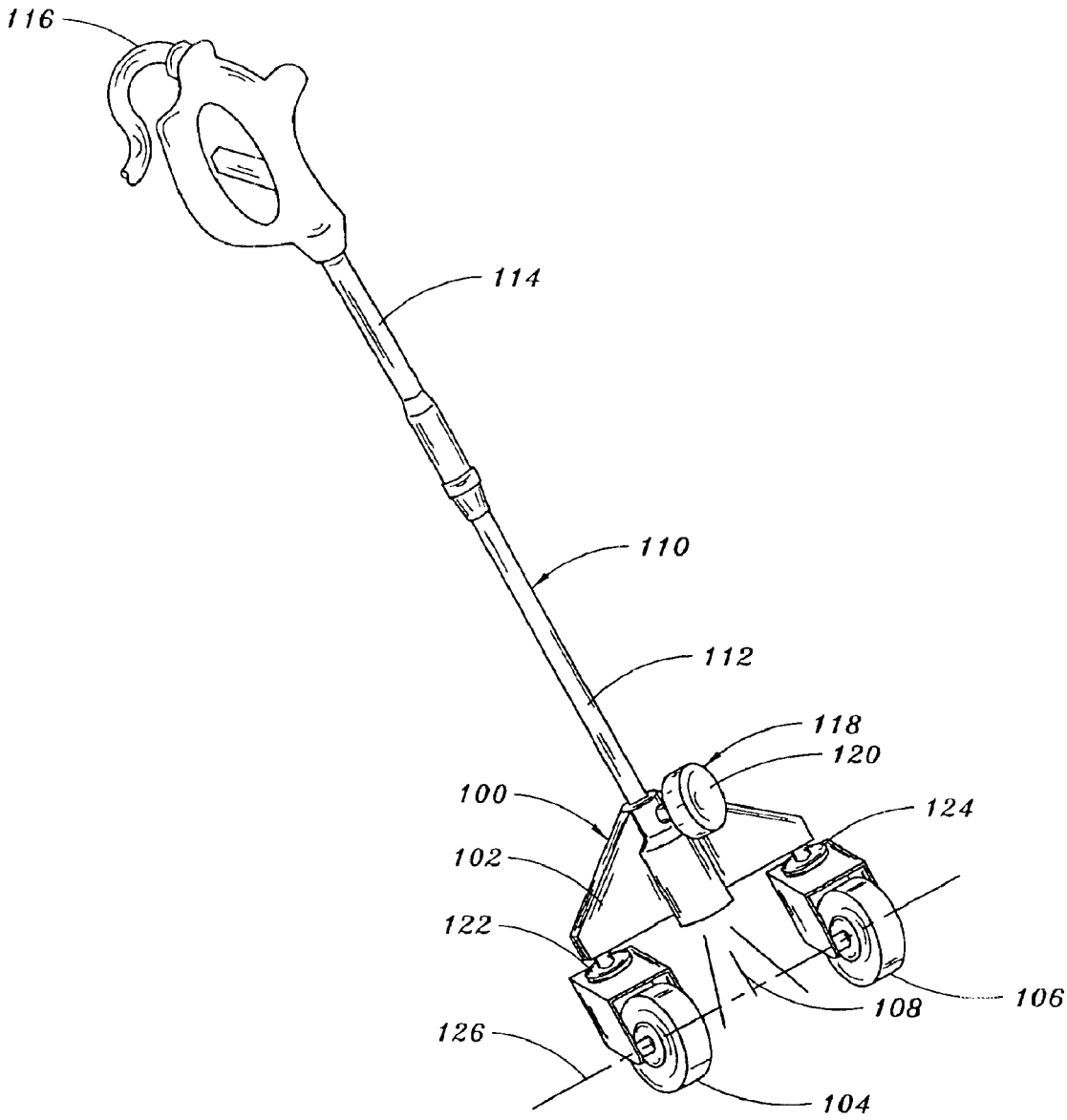
FIG. 2 is an isometric view illustrating a surface cleaner assembly including casters and a set screw in accordance with an exemplary embodiment of the present invention.

As shown in FIGS. 1 and 2, a surface cleaner 100 for a pressure washer assembly in accordance with exemplary embodiments of the present invention includes a guide 102. The guide 102 is shown separated from a spray wand 110 in the exploded view shown in FIG. 1, and coupled with the spray wand 110 in the view shown in FIG. 2. The guide 102 includes an aperture for attaching the guide 102 to the spray wand 110. In exemplary embodiments of the present invention, the aperture may be of varying diameter to accommodate different spray wands, lances, spray nozzles, and the like. For instance, the guide 102 shown in FIGS. 1 and 2 includes an aperture of increasing diameter, for accommodating a spray nozzle of the spray wand 110. The spray wand 110 includes a lance 112 having a spray nozzle for delivering a pressurized fluid stream 108 to a surface and a gun 114 for regulating the flow of the pressurized fluid stream 108. The gun 114 is connected to a pressure hose 116 which delivers the pressurized fluid stream 108 from a pump assembly (not shown) to the spray wand 110. In exemplary embodiments of the present invention, the guide 102 is adjustably coupled with the lance 112 for allowing a user of the surface cleaner 100 to vary the impingement distance. For instance, in the exemplary embodiment of the present invention shown in FIG. 1, the guide 102 may be formed to slide onto the lance 112 and remain in place through a friction interface between the guide 102 and the lance 112. The friction interface may be such as to allow a user of the surface cleaner 100 to adjust the position of the guide 102 relative to the lance 112 by overcoming the frictional force and sliding the guide 102 relative to the lance 112. Further, in the exemplary embodiment of the present invention shown in FIG. 2, the guide 102 may include a set screw 118 having a knob 120, threadably connected to the guide 102. By using the knob 120 to tighten the set screw 118 against the lance 112, the guide 102 may be locked in position relative to the lance 112.

While the spray wand 110 shown in FIGS. 1 and 2 includes a single lance 112 including a spray nozzle, those of ordinary skill in the art will appreciate that a guide 102 may be formed for a variety of pressure washer assembly configurations, including rotary lances, spray wands including two separate lances, spray wands including spray lances having separable or extensible components, and the like. For example, a guide 102 may be formed for a spray wand having two separate lances by including two separate apertures in the guide 102, including one aperture large enough for both lances, and the like. It should also be noted that a guide 102 may be formed with an aperture not fully enclosing the lance 112, capable of flexing for coupling with a spray lance of larger diameter.

Those of ordinary skill in the art will appreciate that other interfaces between the guide 102 and the lance 112 may be utilized without departing from the scope and intent of the present invention. For instance, in further exemplary embodiments of the present invention, interference protrusions, teeth, grooves, and the like may be formed on or attached to the guide 102 and the lance 112 for providing locking positions for the guide 102 relative to the lance 112. The use of interference protrusions, teeth, grooves, and the like may have an added advantage of providing preset or manufacturer defined locking positions for setting the position of the guide 102 relative to the lance 112. For example, interference protrusions formed on the inside surface of the guide 102 may interface with grooves formed on the outside surface of the lance 112, providing a number of preset locking positions for the guide 102 relative to the lance 112. Preset locking positions may be desirable for supplying impingement distances appropriate for various surface types, surface orientations, and the like. In exemplary embodiments of the present invention, such preset locking positions may be provided in combination with descriptive markings on the guide 102 or the lance 112, for indicating desirable positions for various surface types, surface orientations, and the like.

As shown in FIGS. 1 and 2, the wheels 104 and 106 are rotationally connected to the guide 102 for supporting the guide 102 upon a surface. In the exemplary embodiment of the present invention shown in FIG. 1, the wheels 104 and 106 are connected to the guide 102 via connecting members formed as part of the guide 102. Those of ordinary skill in the art will appreciate that the wheels 104 and 106 may be attached to the guide 102 using various connecting members such as bolts, pins, rivets, rods, screws, and the like without departing from the scope and spirit of the present invention. For instance, the wheels 104 and 106 may be connected to the guide 102 via swivels 122 and 124 (casters) as shown in the exemplary embodiment of the present invention shown in FIG. 2.

The wheels 104 and 106 are attached to the guide 102 such that the pressurized fluid stream 108 intersects the axis of rotation of the wheels 126. By aligning the wheels 104 and 106 with the spray nozzle of the lance 112 in this way, the impingement distance may be substantially maintained through a variety of angles between the spray wand 110 and the surface (hereinafter referred to as impingement angles). Those of ordinary skill in the art will appreciate that while change in the impingement distance may be greater for large changes in the impingement angle (e.g. from 10 degrees to 80 degrees), change in the impingement distance may not be substantial for changes in the impingement angle encountered in the course of normal operation of the surface cleaner 100 (e.g. 40 degrees to 70 degrees); thus the impingement distance may be substantially maintained through a variety of impingement angles.

Figure 3:
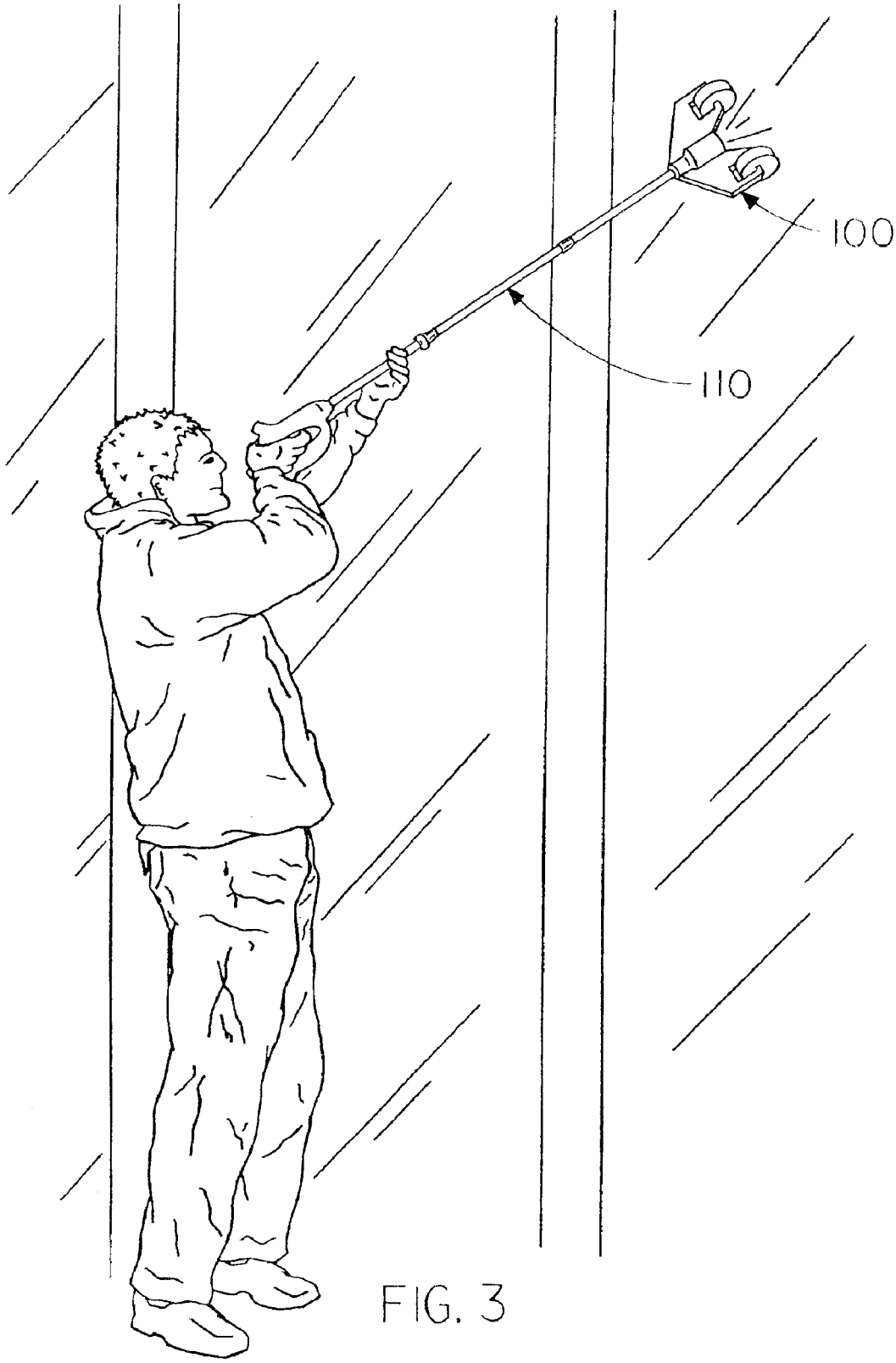
FIG. 3 is an isometric view illustrating a surface cleaner assembly being used to clean a vertical surface in accordance with an exemplary embodiment of the present invention.

Referring generally now to FIG. 3, a surface cleaner 100 in accordance with an exemplary embodiment of the present invention may be attached to a spray wand 110 and used for supporting the spray wand 110 to clean a vertical surface while substantially maintaining an impingement distance. The guide 102 (FIGS. 1 and 2) may be made of a lightweight material such as plastic or a composite material, allowing a user to easily support the spray wand 110 while cleaning a vertical surface. In exemplary embodiments of the present invention, the wheels 104 and 106 (FIGS. 1 and 2) may be constructed from material selected to provide support for the spray wand 110 while not marring or scratching surfaces upon which the wheels 104 and 106 (FIGS. 1 and 2) are used for supporting the spray wand 110.

Figure 4:
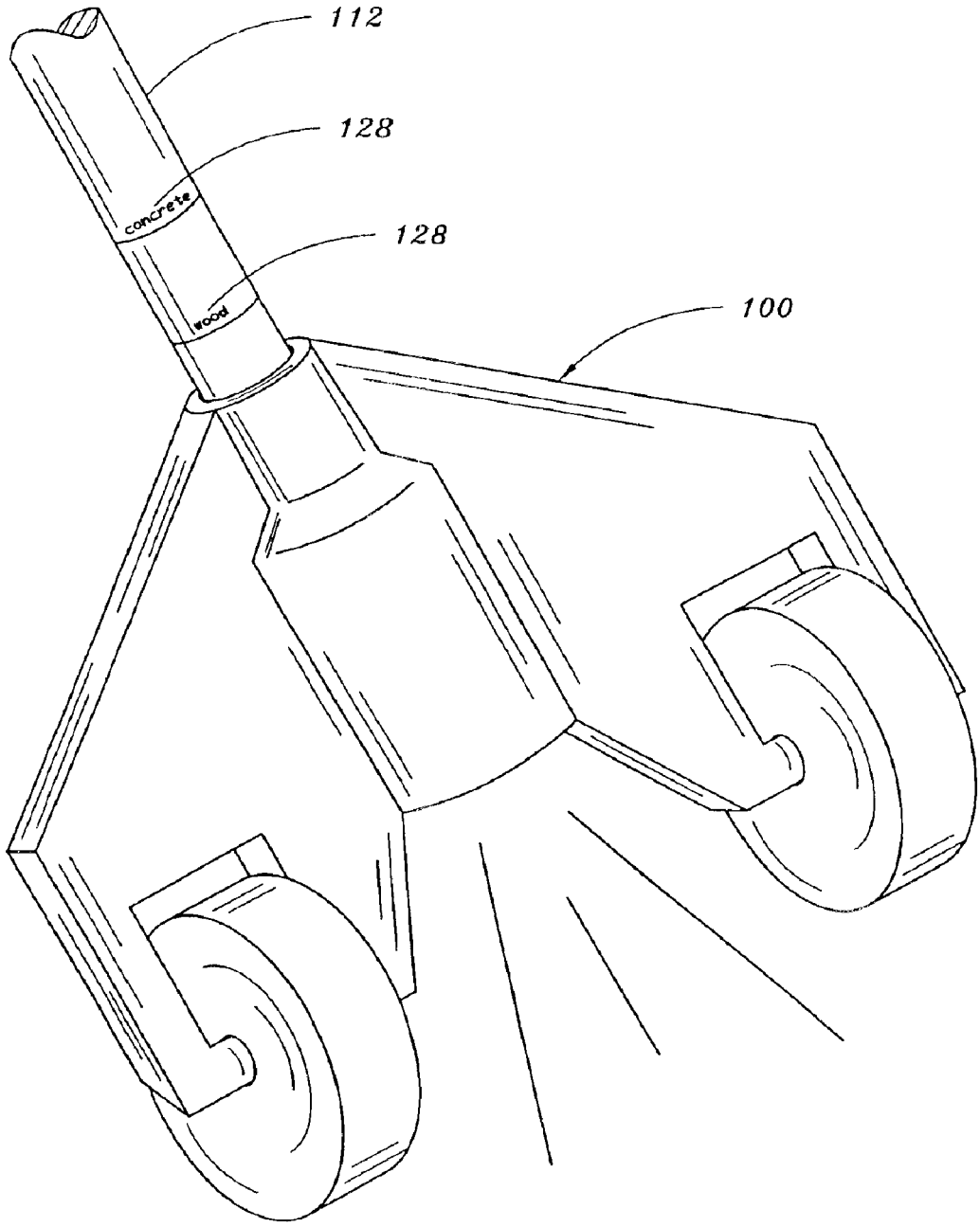
FIG. 4 is an isometric view illustrating a surface cleaner assembly adjustably coupled with a spray lance having descriptive markings in accordance with an exemplary embodiment of the present invention.

Referring generally to FIG. 4, a surface cleaner 100 is shown slidably connected to a spray lance 112, the spray lance 112 having a set of descriptive markings 128 in accordance with an exemplary embodiment of the present invention. The descriptive markings 128 may indicate optimum positions for the surface cleaner 100 relative to the spray lance 112 for various surfaces. For instance, the set of descriptive markings 128 may indicate that the spray nozzle may be used closer to a concrete surface than to a wood surface. In this case, a line and an appropriate label may be applied to the spray lance 112 indicating the ideal position for the surface cleaner 100 in relation to the spray lance 112 for cleaning a concrete surface. Similarly, a line and an appropriate label may be applied some distance further down the spray lance 112 for indicating the ideal position for the surface cleaner 100 in relation to the spray lance 112 for cleaning a wood surface.

In exemplary embodiments of the present invention, such a set of descriptive markings may also be applied to the surface cleaner 100. For instance, a set of surface types may be listed on the guide 102 (FIGS. 1 and 2) indicating ideal distances for the spray nozzle from various surfaces. It should also be noted that different positions for the surface cleaner 100 in relation to the spray lance 112 may be noted for different surface orientations, impingement angles, and the like. For instance, a surface cleaner 100 used primarily for washing vertical surfaces may include a set of descriptive markings 128 indicating ideal positions for the surface cleaner 100 in relation to the spray lance 112 for such surfaces.

Figure 5:
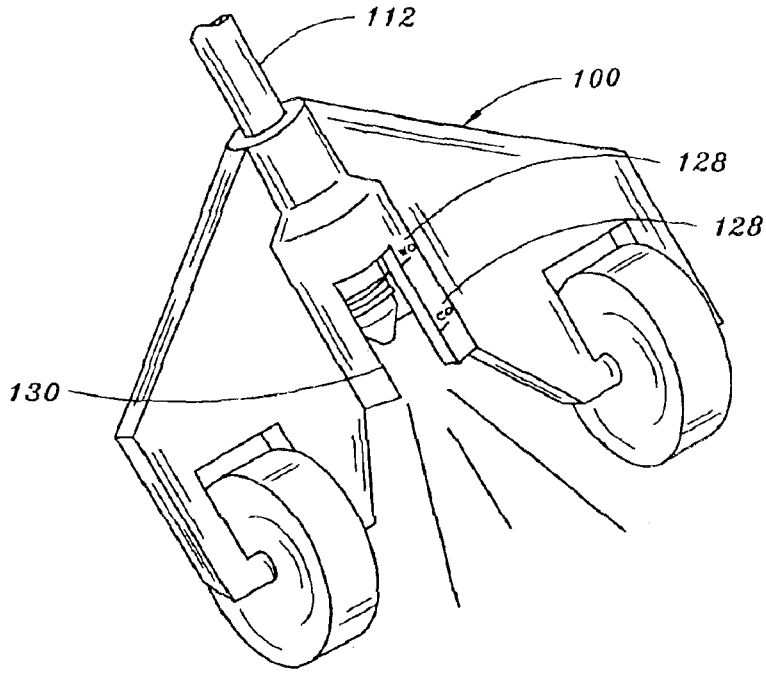
FIG. 5 is an isometric view illustrating a surface cleaner assembly adjustably coupled with a spray lance, including a notch for viewing the spray lance in accordance with an exemplary embodiment of the present invention.
Figure 6:
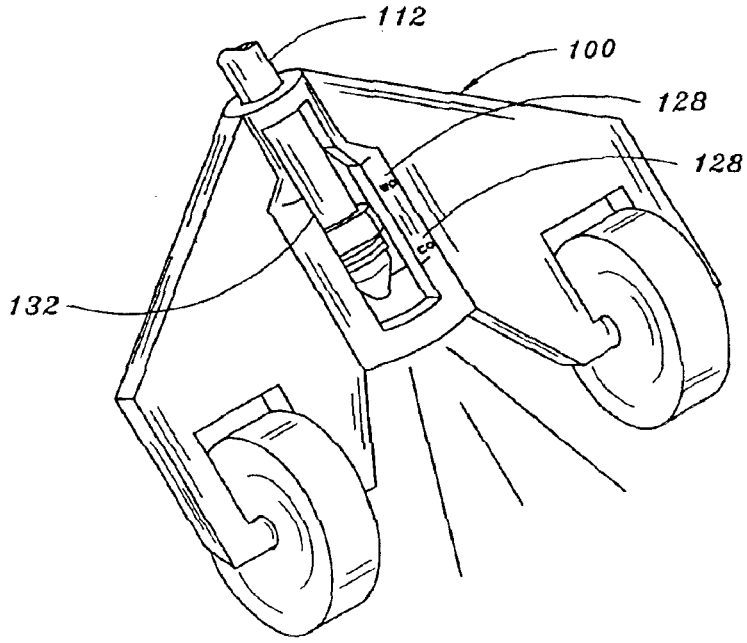
FIG. 6 is an isometric view illustrating a surface cleaner assembly adjustably coupled with a spray lance, including a window for viewing the spray lance in accordance with an exemplary embodiment of the present invention.

Referring generally now to FIGS. 5 and 6, a surface cleaner 100 is shown in accordance with exemplary embodiments of the present invention. The surface cleaner 100 may include a notch 130 (FIG. 5) or a window 132 (FIG. 6) located in the guide 102 (FIGS. 1 and 2) for viewing the position of the spray lance 112. Such a notch may allow a user of the surface cleaner to determine the position of the spray lance 112 (and thus the position of the spray nozzle) when the spray nozzle is located at some distance inside the guide 102 (FIGS. 1 and 2). In exemplary embodiments of the present invention, the notch 130 (FIG. 5) or the window 132 (FIG. 6) may be used in combination with a plurality of descriptive markings 128 disposed on either of the lance 112 or the guide 102 (FIGS. 1 and 2). Such descriptive markings 128 may allow the user of the surface cleaner 100 to determine the ideal position of the surface cleaner 100 in relation to the lance 112. It should be noted that descriptive markings may be provided for various surface types, impingement angles, and the like without departing from the scope and intent of the present invention. It should also be noted that the notch 130 (FIG. 5) or the window 132 (FIG. 6) may also be used to view the plurality of descriptive markings 128 when such descriptive markings are disposed on the lance 112 (as discussed in FIG. 4).

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A pressure washer having a surface cleaner, comprising:

a guide;

a spray nozzle adjustably coupled with the guide for delivering a pressurized fluid stream to a surface;

a wheel rotationally connected to the guide for supporting the guide upon the surface, the wheel having an axis of rotation;

a fluid supply; and a fluid supply delivery system connecting the spray nozzle to the fluid supply for supplying the pressurized fluid stream to the spray nozzle, wherein the pressurized fluid stream intersects the axis of rotation of the wheel while a spray nozzle distance from the surface is adjustable.

2. The pressure washer of claim 1, wherein the guide further comprises a plurality of descriptive markings for indicating a plurality of guide positions.

3. The pressure washer of claim 2, wherein the plurality of descriptive markings comprises a plurality of guide positions for a plurality of surface types.

4. The pressure washer of claim 2, wherein the plurality of descriptive markings comprises a plurality of guide positions for a plurality of horizontal surfaces.

5. The pressure washer of claim 2, wherein the plurality of descriptive markings comprises a plurality of guide positions for a plurality of vertical surfaces.

6. The pressure washer of claim 1, wherein the spray nozzle is slidably connected to the guide.

7. The pressure washer of claim 1, further comprising a lance disposed of the guide, the lance connected to the spray nozzle for supplying the pressurized fluid stream to the spray nozzle.

8. The pressure washer of claim 7, wherein the lance is adjustably coupled to the guide.

9. The pressure washer of claim 8, wherein the lance further comprises a plurality of descriptive markings for indicating a plurality of guide positions.

10. The pressure washer of claim 9, wherein the plurality of descriptive markings comprises a plurality of guide positions for a plurality of surface types.

11. The pressure washer of claim 9, wherein the plurality of descriptive markings comprises a plurality of guide positions for a plurality of horizontal surfaces.

12. The pressure washer of claim 9, wherein the plurality of descriptive markings comprises a plurality of guide positions for a plurality of vertical surfaces.

13. The pressure washer of claim 8, further comprising a set screw threadably connected to the guide for being tightened against the lance for providing plurality of locking positions.

14. The pressure washer of claim 7, wherein the lance is slidably connected to the guide.

15. The pressure washer of claim 1, wherein the wheel comprises a caster.

16. A surface cleaner, comprising:

a guide for adjustably coupling with at least one spray nozzle; and a wheel rotationally connected to the guide for supporting the guide upon a surface, the wheel having an axis of rotation, wherein at least one spray nozzle is aligned to intersect the axis of rotation of the wheel while a spray nozzle distance from the surface is adjustable.

17. The surface cleaner of claim 16, wherein the guide further comprises a plurality of descriptive markings for indicating a plurality of guide positions.

18. The surface cleaner of claim 17, wherein the plurality of descriptive markings comprises a plurality of guide positions for a plurality of surface types.

19. The surface cleaner of claim 17, wherein the plurality of descriptive markings comprises a plurality of guide positions for a plurality of horizontal surfaces.

20. The surface cleaner of claim 17, wherein the plurality of descriptive markings comprises a plurality of guide positions for a plurality of vertical surfaces.

21. The surface cleaner of claim 16, further comprising a set screw threadably connected to the guide.

22. The surface cleaner of claim 16, wherein the wheel comprises a caster.

23. A surface cleaner, comprising:

a guide for adjustably coupling with at least one spray lance; and a wheel rotationally connected to the guide for supporting the guide upon a surface, the wheel having an axis of rotation, wherein at least one spray lance is aligned to intersect the axis of rotation of the wheel while a spray nozzle distance from the surface is adjustable.

24. The surface cleaner of claim 23, wherein the guide further comprises a plurality of descriptive markings for indicating a plurality of guide positions.

25. The surface cleaner of claim 24, wherein the plurality of descriptive markings comprises a plurality of guide positions for a plurality of surface types.

26. The surface cleaner of claim 24, wherein the plurality of descriptive markings comprises a plurality of guide positions for a plurality of horizontal surfaces.

27. The surface cleaner of claim 24, wherein the plurality of descriptive markings comprises a plurality of guide positions for a plurality of vertical surfaces.

28. The surface cleaner of claim 23, further comprising a set screw threadably connected to the guide.

29. The surface cleaner of claim 23, wherein the wheel comprises a caster.

* * * * *